US010373536B2

(12) United States Patent
Sherretts et al.

(10) Patent No.: US 10,373,536 B2
(45) Date of Patent: Aug. 6, 2019

(54) 3D SIGNAGE USING AN INVERSE CUBE ILLUSION FIXTURE

(71) Applicants: Jeffrey Sherretts, North Babylon, NY (US); Jamison Sherretts, North Babylon, NY (US)

(72) Inventors: Jeffrey Sherretts, North Babylon, NY (US); Jamison Sherretts, North Babylon, NY (US)

( * ) Notice: Subject to any disclaimer, the term of this patent is extended or adjusted under 35 U.S.C. 154(b) by 0 days.

(21) Appl. No.: 15/794,309

(22) Filed: Oct. 26, 2017

(65) Prior Publication Data

US 2018/0342183 A1 Nov. 29, 2018

Related U.S. Application Data

(60) Provisional application No. 62/511,897, filed on May 26, 2017.

(51) Int. Cl.

| | |
|---|---|
| ***G09F 19/12*** | (2006.01) |
| ***F21K 9/62*** | (2016.01) |
| ***G09F 13/04*** | (2006.01) |
| ***F21V 3/00*** | (2015.01) |
| ***G09F 3/00*** | (2006.01) |

(Continued)

(52) U.S. Cl.

CPC ..... *G09F 19/12* (2013.01); *F21K 9/62* (2016.08); *F21V 3/00* (2013.01); *G09F 3/00* (2013.01); *G09F 13/0413* (2013.01); *F21Y 2103/10* (2016.08); *F21Y 2115/10* (2016.08)

(58) Field of Classification Search

CPC ..... G09F 19/12; G09F 13/0413; G09F 3/00; F21K 9/62; F21V 3/00; F21V 2103/10

See application file for complete search history.

(56) References Cited

U.S. PATENT DOCUMENTS

| | | | |
|---|---|---|---|
| 1,456,230 | A | 5/1923 | Hammond |
| 2,061,378 | A | 11/1936 | Henze |

(Continued)

OTHER PUBLICATIONS

Dr. Benjamin Backus, "The Improved Cube Illusion," Dept. of Psychology, Univ. of Penn., 1999, available at: http://poseidon.sunyopt.edu/BackusLab/sites/default/files/cubeillusion_0.pdf.

(Continued)

*Primary Examiner* — Gary C Hoge

(74) *Attorney, Agent, or Firm* — Thomas A. O'Rourke; Bodner & O'Rourke, LLP

(57) ABSTRACT

An improved three-dimensional sign includes three light boxes each having a light box housing, a light or lights, a light diffuser, and a bezel configured to releasably secure a graphical image in contact with the respective diffuser. Each of the three bight box housings and the respective diffusers are formed with respective selectively-shaped peripheries. The first, second, and third light boxes are selectively positioned with respect to each other within a fixture housing that provides a dark background tot the backlit graphics, for the three selectively shaped peripheries and graphics to create a particular inverse cube illusion. The structural arrangement also provides the illusion that the statically displayed advertise lent graphic(s) is/are directed towards and follows the consumer as he/she approaches and then walks past the sign. The dark environment is provided by a housing of sufficient depth, having a dark surface that is preferably black.

15 Claims, 12 Drawing Sheets

(51) Int. Cl.
*F21Y 115/10* (2016.01)
*F21Y 103/10* (2016.01)

(56) References Cited

U.S. PATENT DOCUMENTS 2,147,748 A 2/1939 Miller
2,232,110 A 2/1941 Gruenhut
2,336,508 A 12/1943 Smith
2,756,528 A 7/1956 Silver
3,093,918 A 6/1963 Krakauer
3,178,843 A * 4/1965 Hammer ..... G09F 19/12 40/431
3,593,447 A 7/1971 Winegarten
3,707,115 A 12/1972 Rush
4,308,016 A 12/1981 White
5,345,705 A 9/1994 Lawrence
5,418,579 A 5/1995 Jamieson
5,580,056 A 12/1996 Clark
5,743,038 A 4/1998 Soto
5,761,838 A * 6/1998 Chisholm ..... A47G 33/08 40/716
5,982,374 A 11/1999 Wahl
8,479,427 B2 7/2013 Verheye
2002/0000057 A1* 1/2002 Nash ..... G09F 13/04 40/564
2005/0275914 A1 12/2005 Vesely
2006/0150465 A1* 7/2006 Chen ..... G09F 19/12 40/798
2006/0284788 A1* 12/2006 Robinson ..... G09F 19/12 345/3.1
2011/0035976 A1* 2/2011 Williams ..... G09F 1/06 40/124.14
2014/0182177 A1* 7/2014 Wang ..... G09F 13/0413 40/564
2015/0201763 A1* 7/2015 Choi ..... G09F 13/0413 40/716
2017/0124770 A1* 5/2017 Vats ..... G06T 19/00

OTHER PUBLICATIONS

Prof. Benjamin T. Backus, "Illusions, the Brain, and How We See, Part I," The Secret Science Club lecture, Dec. 8, 2009, available at: https://www.youtube.com/watch?v=zHB-1kH91Ts.

* cited by examiner

FIG. 1
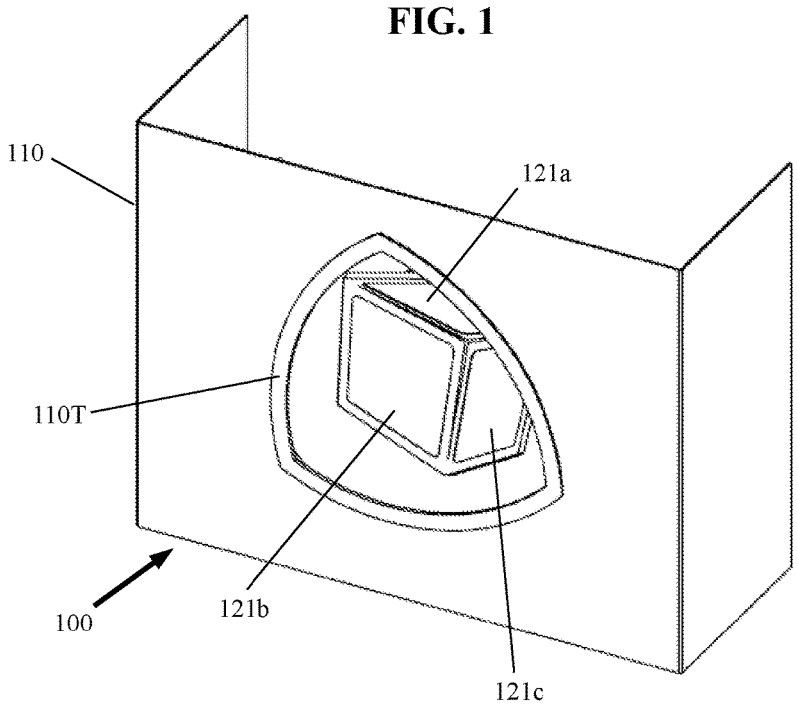
FIG. 2
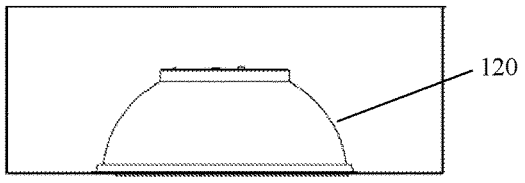
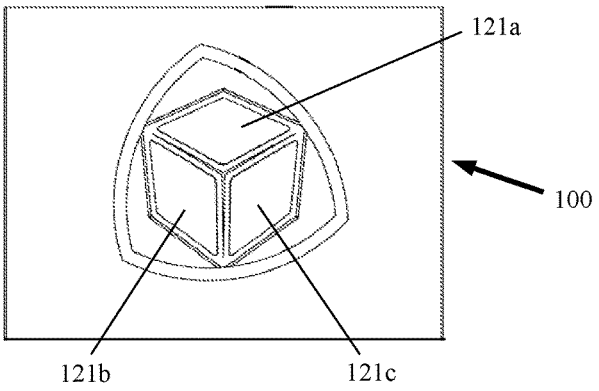
FIG. 3

FIG. 8
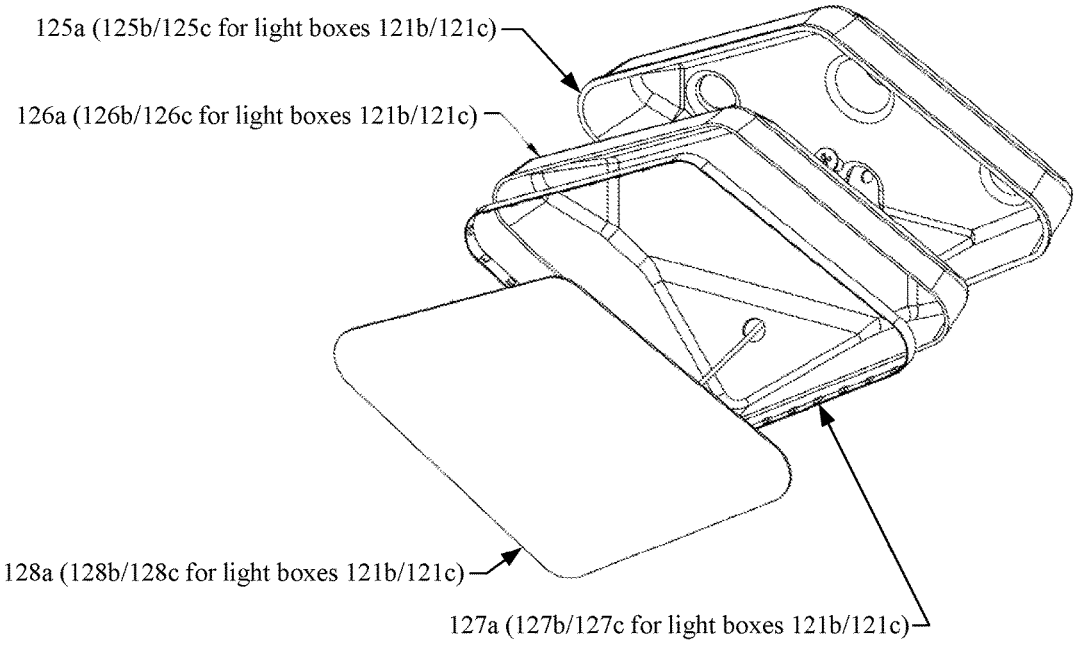
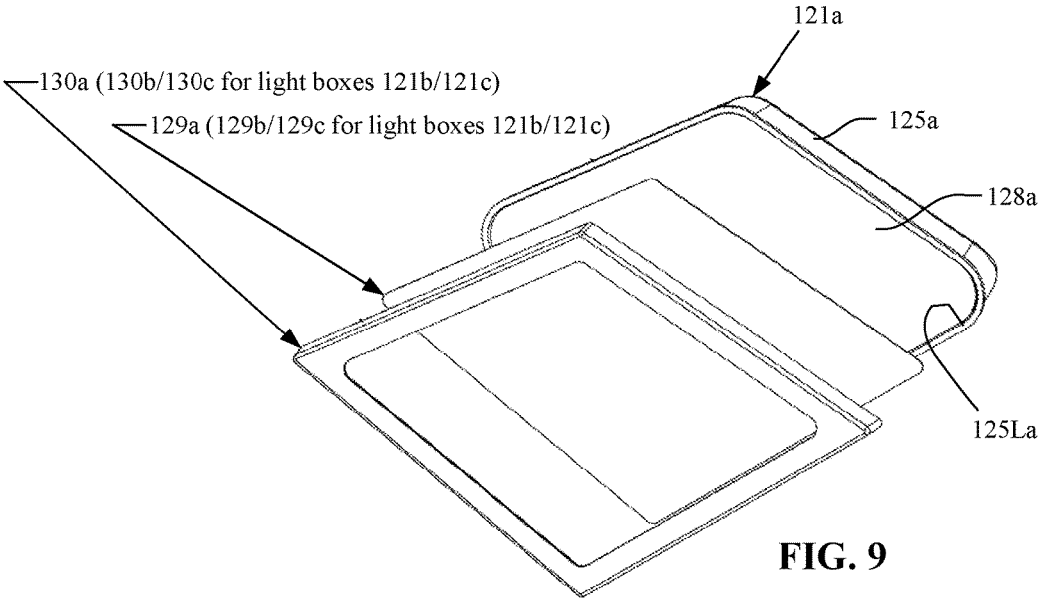
FIG. 9

FIG. 10
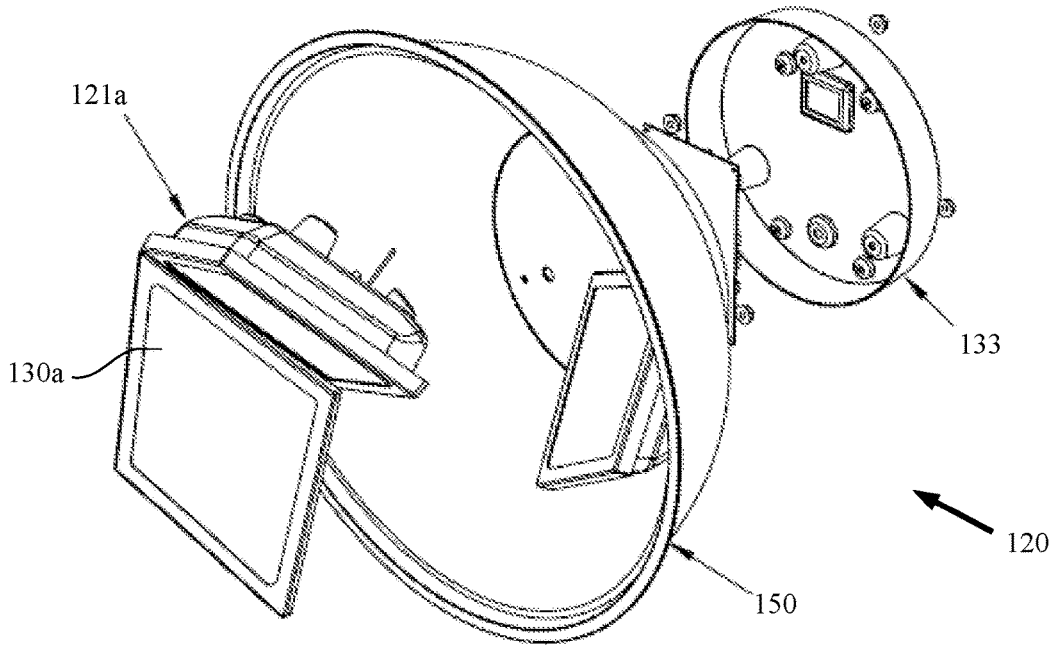
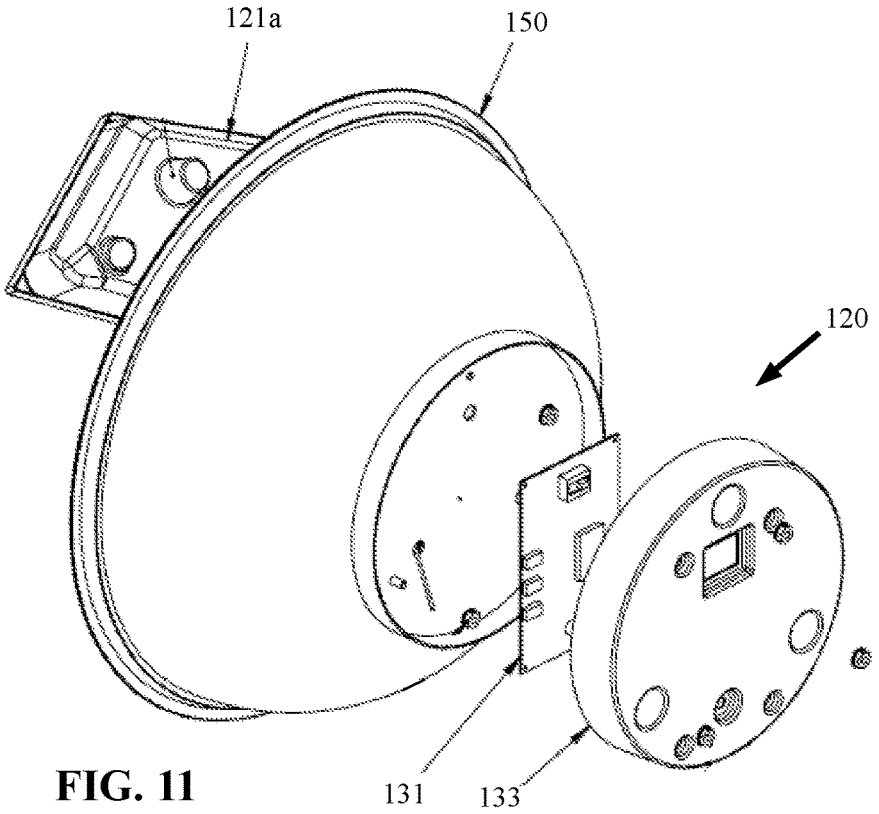
FIG. 11

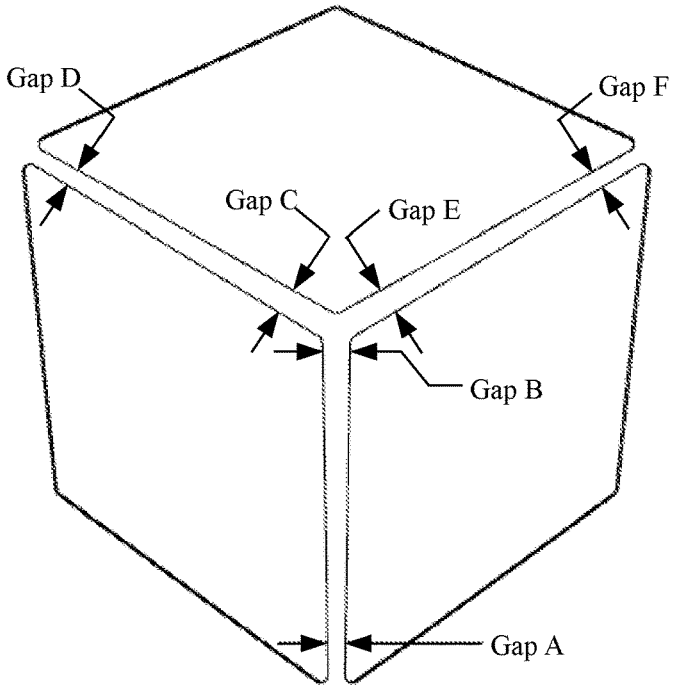
FIG. 14
FIG. 14A
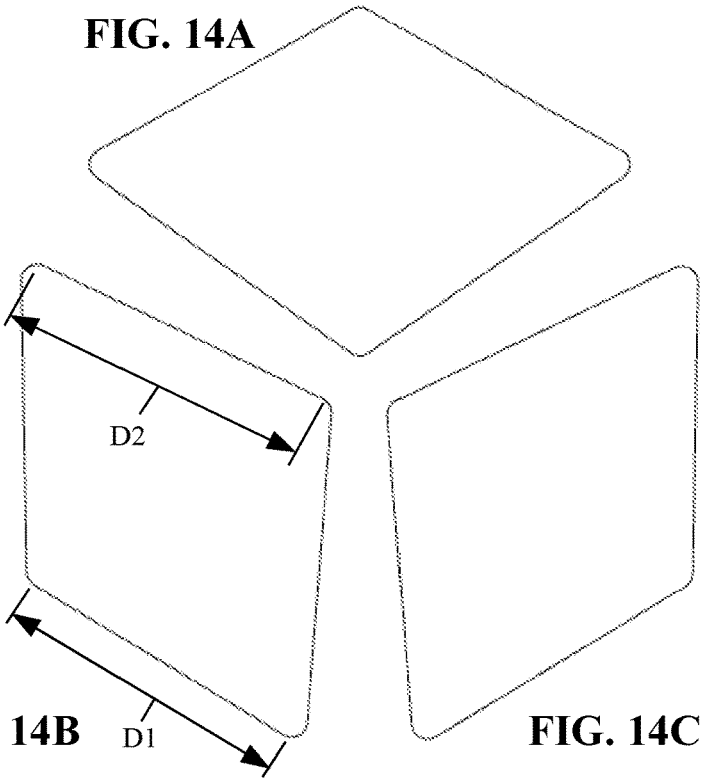
FIG. 14B
FIG. 14C (top image unaltered)

(top image deformed)

(left image unaltered)

(left image deformed)

(left image unaltered)

(left image deformed)

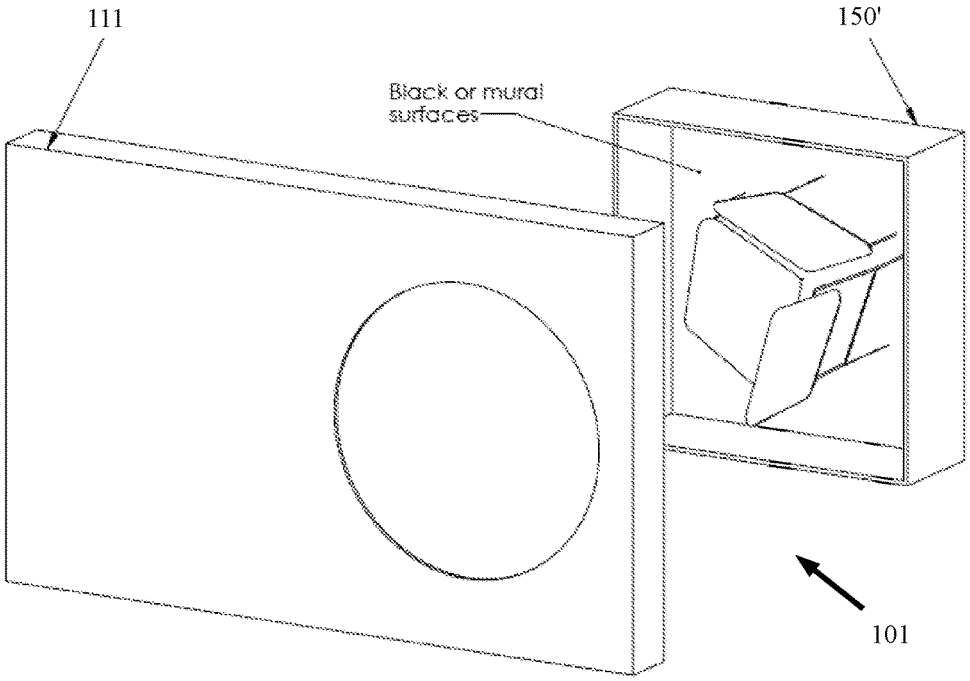
FIG. 17
FIG. 18
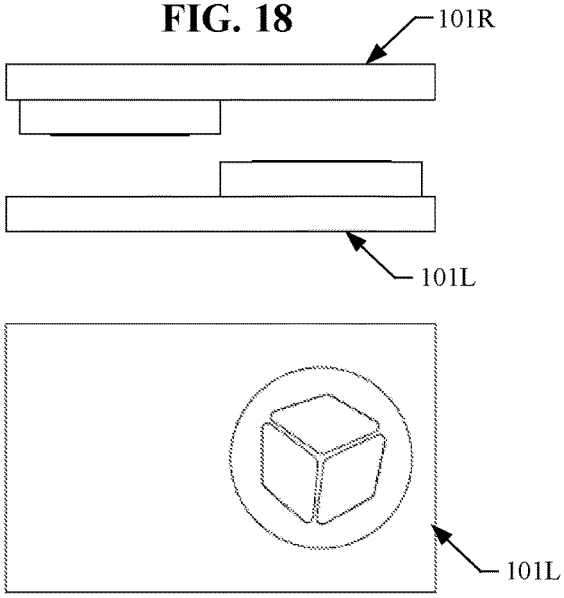
FIG. 19
FIG. 20
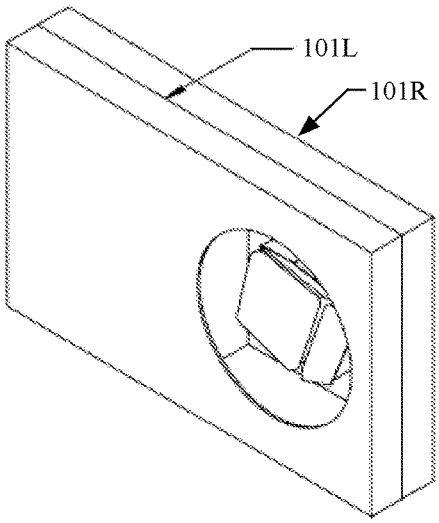

FIG. 25
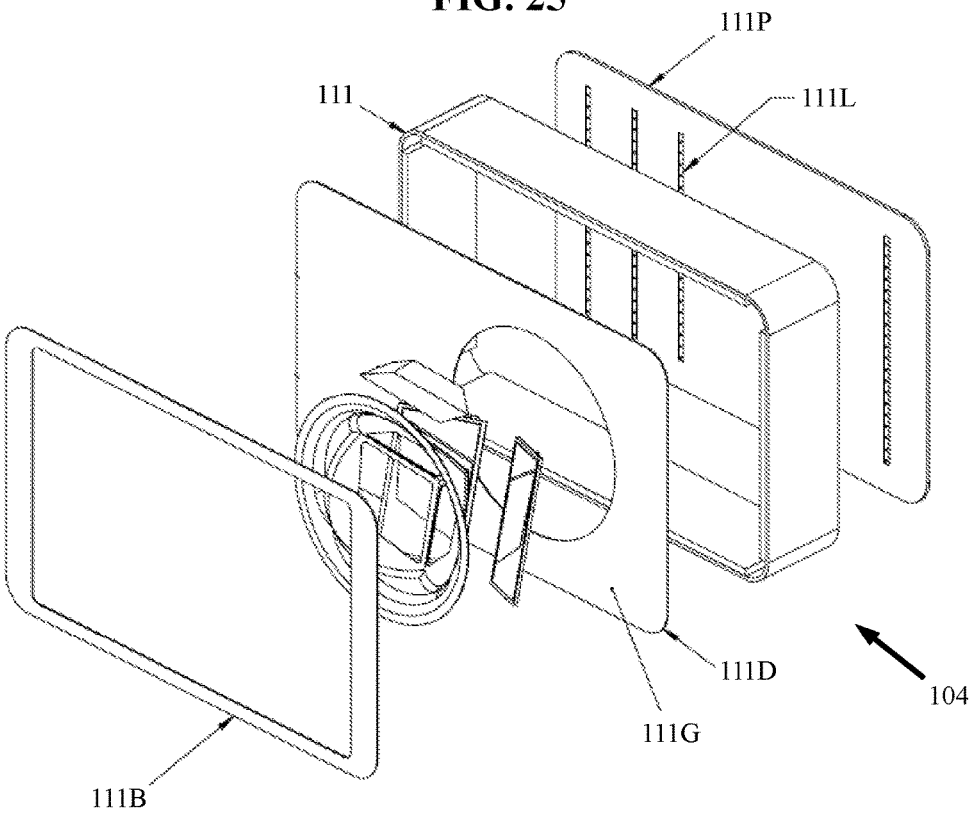
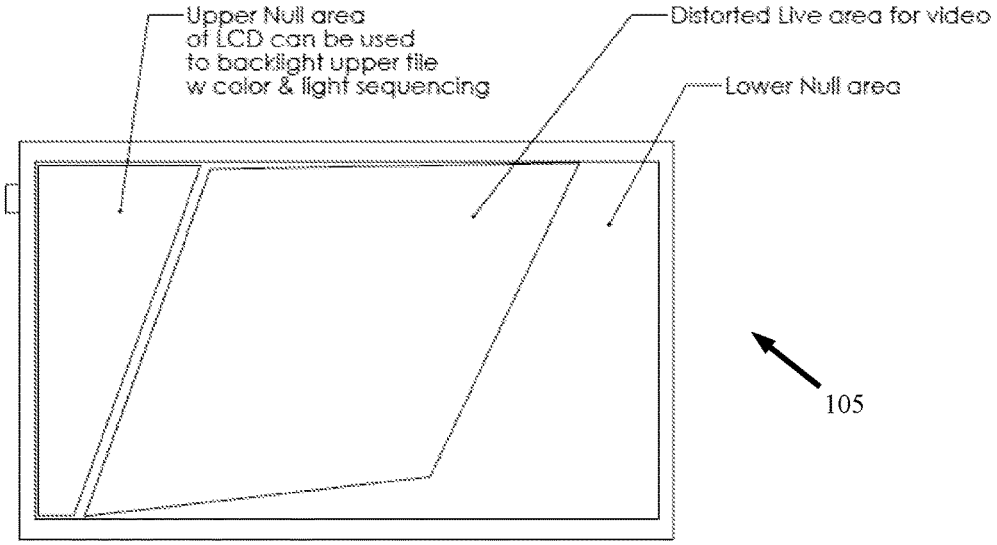
FIG. 26

3D SIGNAGE USING AN INVERSE CUBE ILLUSION FIXTURE

CROSS REFERENCES TO RELATED APPLICATIONS

This application claims priority on U.S. Provisional Application Ser. No. 62/511,897 filed on Jun. 26, 2017, all disclosures of which are incorporated herein by reference in their entirety.

FIELD OF THE INVENTION

The present invention relates to three-dimensional signage, and more particularly to signage that is configured to attract and maintain the attention of consumers.

BACKGROUND OF THE INVENTION

The use of signage dates hack to the ancient world, when signs were either carved into wood or drawn on rocks/stone. One of the earliest laws regarding the use of signs was enacted in 1389 by King Richard II of England, requiring taverns to post signs regarding the ale that was sold. The development of printing—wood block printing and the printing press—led to the use of posters and billboards, and was soon followed by gas lit displays and theatre marquees.

The first electric sign was displayed at the International Electric Exposition in 1882, and neon signs were first demonstrated in 1910 at the Paris Motor Show and were popular between 1920 and 1960. The types of signs used to advertise continue to be innovative, to attempt to attract the attention of, and captivate consumers. Today, it is not uncommon to see signs with digital lettering, and signs that use video. The present invention offers additional improvements to advertising signage.

OBJECTS OF THE INVENTION

It is an object of the invention to provide an improved signage fixture that is useful for advertising.

It is a further object of the invention to provide a sign for advertising that is eye-catching to attract the attention of consumers.

It is another object of the invention to provide a lighted sign configuration that provides an improved optical illusion as to the appearance of a displayed advertisement.

It is a further object of the invention to provide a sign that uses a three-dimensional illusion fixture.

It is another object of the invention to provide a lighted sign configuration that provides the illusion that the statically displayed advertisement is directed towards and follows the consumer as he/she approaches and then walks past the sign.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment, an improved three-dimensional sign may include: a first light box with a housing, a diffuser, and a bezel; a second light box with a housing, a diffuser, and a bezel; and a third light box with a housing, a diffuser, and a bezel. Each of the light boxes may contain lights that'may be in the form of an LED strip. The diffuser for each of the first, second, and third light boxes may include respective selectively-shaped peripheries. The diffuser of the first light box, the diffuser of the second light box, and the diffuser of the third light box are selectively positioned with respect to each other for the first, second, and third selectively shaped peripheries to create a particular inverse cube illusion.

The bezel of each of the first, second, and third light boxes is respectively configured to releasably support a graphical image in contact with the respective diffuser, which may be backlit by the light box. In one embodiment the graphical image may be formed upon a plastic film or sheet, where some portion of the plastic film/sheet may be transparent, and some portion is at least translucent to permit backlighting of the image on that portion of the film/sheet. In another embodiment, the bezel may be eliminated, as the graphical image may be formed directly upon the diffuser. In another embodiment, the graphic may be projected/transmitted onto a screen of the light box, such as a liquid crystal display screen, which may be used in place of a diffuser. In another embodiment the graphic may he made using lenticular sign material. (i.e., frosted plastic image shifting material that makes the image appear to move as you change the viewing angle), to accentuate the illusion discussed hereinafter. The image to be backlit, whether formed as described above, or using any other suitable method/manner, is simply referred to hereinafter as a "graphic" without intending to limit the various different approaches for backlighting of the desired image. The inverse cube illusion being particularly formed, when placed in a dark environment, and with only the graphic being properly illuminated from behind, provides the illusion that the statically displayed advertisement is directed towards and follows the consumer as he/she approaches and then walks past the sign. The dark environment may be provided by a housing that may be of sufficient depth, and having a dark interior surface that faces the consumer, and which is preferably black. The housing may be formed to provide various different ornamental appearances, which shapes may include: a dome shape; cube shape; a cylindrical shape; a dodecahedron shape; an octahedron shape; an icosahedron shape; and any other polyhedron shape, such as a pyramid frustum shape, and a full pyramid shape, where the pyramid may have any suitable base shape, such as a rectangular base, a pentagonal base, a hexagonal base, an octagonal base, etc. A rear portion of the shaped housing may be formed into an enclosure for electronics.

BRIEF DESCRIPTION OF THE DRAWINGS

The description of the various example embodiments is explained in conjunction with appended drawings, in which:

FIG. 1 illustrates a perspective cross-sectional view of a portion of a first embodiment of an illusion signage fixture constructed in accordance with the present invention;

FIG. 2 is a top view of the illusion signage fixture shown in FIG. 1;

FIG. 3 is a front view of the illusion signage fixture shown in FIG. 1;

FIG. 8 is an exploded view of the components that form a first embodiment of the light box that may be used in the illusion signage fixture of FIG. 1;

FIG. 9 is an exploded view illustrating releasable attachment of a graphic to the diffuser of the light box frame using a bezel;

FIG. 10 is a first exploded view of the components that form the housing of FIG. 4, and light boxes installed therein;

FIG. 11 is a second exploded view of the components that form the housing of FIG. 4, and light boxes installed therein;

FIG. 14 illustrates improvements made to positioning of separate sides that form a cube illusion in accordance with the illusion signage fixture shown in FIG. 1;

FIG. 14A is an exemplary flat pattern shape that may be used for the diffuser, mixing chamber, and light box housing represented by the top tile shown in FIG. 14;

FIG. 14B is an exemplary flat pattern shape that may be used for the diffuser, mixing chamber, and light box housing represented by the left-side tile shown in FIG. 14;

FIG. 14C is an exemplary flat pattern shape that may be used for the diffuser, mixing chamber, and light box housing represented by the right-side tile shown in FIG. 14;

FIG. 17 illustrates an alternate embodiment of poster structure that may be used to support the light boxes and the housing for an illusion signage fixture;

FIG. 18 illustrates left-hand and right-hand versions of the illusion signage fixture that may be formed using the poster structure of FIG. 17, shown prior to being joined to create a two-sided signage arrangement;

FIG. 19 is a front view of the two-sided signage arrangement formed using the left-hand and right-hand illusion signage fixtures of FIG. 18;

FIG. 20 is a perspective view of the two-sided signage arrangement formed using the left-hand and right-hand versions of the illusion signage fixtures of FIG. 18;

FIG. 25 illustrates a light box embodiment that uses LED backlight strips; and FIG. 26 illustrates use of LCD screens instead of light boxes for yet another embodiment of an illusion signage fixture.

DETAILED DESCRIPTION OF THE INVENTION

Figure 4:
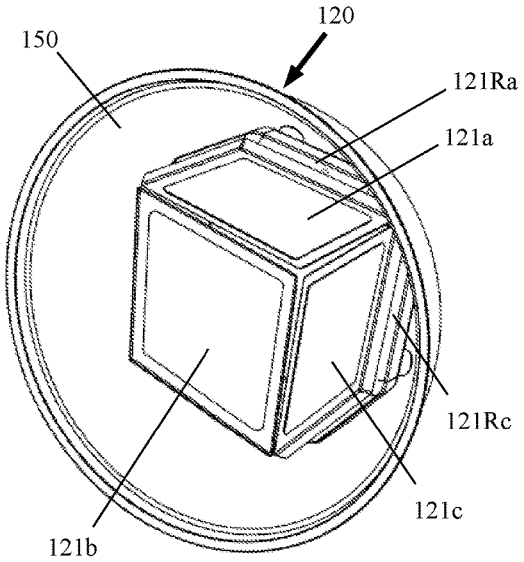
FIG. 4 is a front perspective view of the light boxes, and the housing used to support the light boxes for the illusion signage fixture of FIG. 1.

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference.

Furthermore, the described features, advantages, and characteristics of any particular embodiment disclosed herein, may he combined in any suitable manner with any of the other embodiments disclosed herein.

FIGS. 1-3 respectively illustrate perspective, front, and top views of a portion of a first embodiment of an illusion signage fixture 100. The illusion signage fixture 100 may include a poster signage structure 110 that may be in the form of a hollow box or box portion, and may be used to support an illusion light assembly 120. One or more pieces of trim 110T may surround the opening in the front of the poster signage structure 110 through which a diffuser of each of three light boxes of the illusion light assembly 120 may be seen.

The illusion light assembly 120 is shown in detail in FIGS. 4-7. The illusion light assembly 120 may include a first light box assembly 121*a,* a second light box assembly 121*b,* and a third light box assembly 121*c,* each of which may be particularly positioned and secured within a particularly shaped housing 150. The shaped housing 150, in addition to simply housing those components, may serve to provide a dark background and generally dark environment for the illusion light assembly 120, which preferably forms an inset volume within the poster structure to provide such a dark background, as discussed further hereinafter.

An exploded view of the light box assembly 121*a* is shown in FIG. 8. In one embodiment, the light box assembly 121*a* may be formed with a light box housing 125*a,* a light mixing chamber 126*a,* a light emitting diode (LED) strip 127*a,* and a light diffuser 128*a.* (Note that in another embodiment of the light box assembly, the light box housing may be configured to serve as the mixing chamber). In this embodiment, the mixing chamber 126*a* may be configured to be received into, and secured within, the light box housing 125*a,* using any means known in the art, including, but not limited to, an adhesive, rivets, snap fasteners, other mechanical fastener types/arrangements, etc. The mixing chamber 126*a* is configured to reflect and disperse light for the purpose of achieving an evenly lit diffuser, and may have a white interior surface, or alternatively may have a mirror-like interior surface. The exterior surface of the light box housing is formed with a dark color, which is preferably black. (Note that where the housing is used as the mixing chamber, it may be formed with a dark exterior surface, and a white/mirror-like interior surface). The LED strip 127*a* may be similarly secured around the inside perimeter of the mixing chamber 126 to emit light therein, which light may be scattered by the diffuser 128*a,* reducing he sharpness of any shadows, and softening the light. One or more openings in the light box housing 125*a* may permit an electric cable or cables to pass therethrough, and a similar opening or openings in the mixing chamber 126*a* may permit the cable to enter therein to be electrically coupled to the LED strip 127*a*. The light diffuser 128*a* may be secured to the light box housing 125*a* in any suitable manner. For example, in one embodiment the light diffuser 128*a* may be secured to the light box housing 125*a* using adhesive. In another embodiment, the light diffuser 128*a* may be secured to the light box housing 125*a* by having an outwardly extending protrusion that may snap into a corresponding recess in the housing.

As seen in FIG. 9, the housing 125*a* of the light box assembly 121*a* may extend slightly beyond the installed diffuser 128*a* to create a small peripheral lip 125La. Therefore, in one embodiment, the light box assembly 121*a* may be configured to receive a separate graphic having a graphical image 129*a* formed thereon, over the diffuser 128*a,* which may be surrounded by the lip, and which graphic may be secured in contact therewith using a bezel 130*a*. The bezel 130*a* may be releasably securable to the housing 125*a* in any suitable manner. In one embodiment, the bezel 130*a* may simply snap onto one or more portions of the outer periphery of the housing. In another embodiment, as may be seen in FIG. 10, one side of the bezel 130*a* may be pivotally attached to the housing 125*a* using a hinge, and the other side, of the bezel may snap onto the housing, which may permit easy and quick changing of the graphic 129*a* when desired. In yet another embodiment, the bezel may clip onto some portion of the light box.

Figure 5:
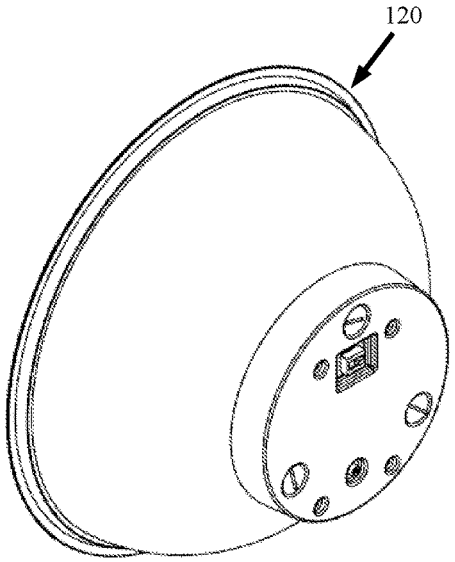
FIG. 5 is a rear perspective view of the light boxes and the housing arrangement shown in FIG. 4.
Figure 21:
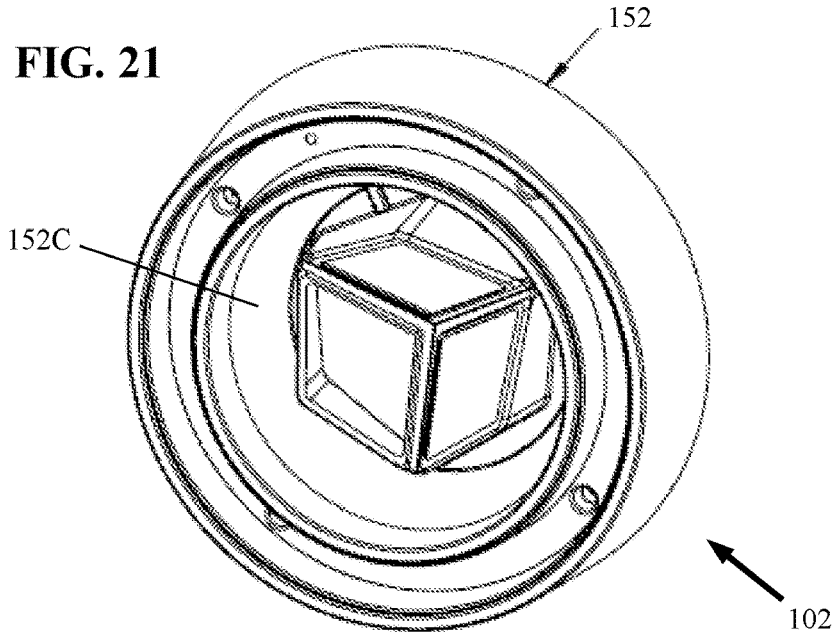
FIG. 21 illustrates an alternate embodiment of a housing that may be used to house the light boxes for another embodiment of the illusion signage fixture.

As seen, in FIGS. 10-11, the shaped housing 150 of the illusion light assembly 120 may be formed with a recess configured to house electronic circuitry 131, which may be protected by a cover plate 133 that may be secured to the shaped housing. In another embodiment, the electronics may be contained in a separate housing that may independently be secured to the signage structure 110, and the shaped housing 150 of the illusion light assembly 120 may be formed without the recess, and may only be formed to have the particular shape desired for housing the light boxes (e.g., a pure dome shape), without provision for simultaneously housing the additional electronics. Such shapes for the housing 150 may provide various different ornamental appearances, which shapes may include: a dome shape (e.g., as shown in FIGS. 4-5): a cube shape (as shown in FIG. 20); a cylindrical shape (as shown in FIG. 21); a dodecahedron shape; an octahedron shape; an icosahedron shape; and any other polyhedron shape, such as a pyramid frustum shape and a full pyramid shape, where the pyramid may have any suitable base shape, such as a rectangular base, a pentagonal base, a hexagonal base, an octagonal base, etc.

FIG. 10 also illustrates installation of the light boxes 121*a*/121*b*/121*c* into the interior of the shaped housing 150. To achieve the optical illusion effect sought herein, a particular arrangement of the light boxes 121*a*/121*b*/121*c* is required, with particular relative positioning with respect to each other, which requires, in one embodiment, that the shapes of all of the light boxes, particularly the peripheries of the diffuser and light box housing, may not be exactly the same, even though the basic construction utilized may be the same.

Therefore, light box 121*b* may be formed with a light box housing 125*b,* a mixing chamber 126*b,* an LED strip 127*b,* and a light diffuser 128*b,* while light box 121*c* may respectively be formed with a light box housing 125*c,* a mixing chamber 126*c,* a light emitting diode (LED) strip 127*c,* and a light diffuser 128*c*. In one embodiment, each of these sets of component parts may have respectively different shapes. In another embodiment light box 121*b* and 121*c* may have the same shape as each other, albeit mirrored, but which are nonetheless distinctly different from the shape of light box 121*a,* and this particular set of shapes may permit the three light boxes to be placed in a specific relation to each other, so that each of the three diffusers, and hence the corresponding graphic for each of the three, may be desirably positioned to create an improved inverse cube optical illusion, as discussed hereinafter. In another embodiment, each of these sets of components may instead be formed to have the same shape.

Figure 12A:
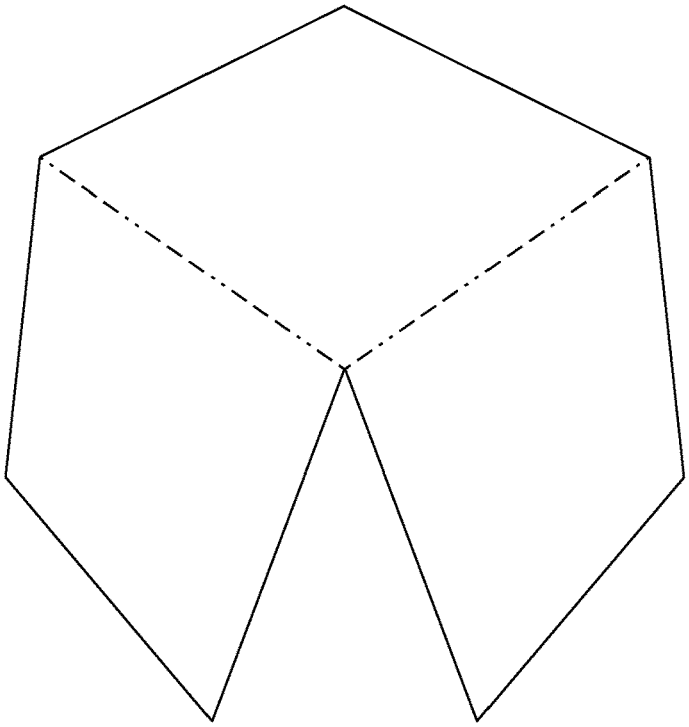
FIG. 12A illustrates a flat pattern that can be bent to present the illusion of a cube.
Figure 12B:
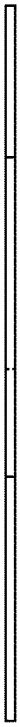
FIG. 12B is a side view of the flat pattern of FIG. 12A.
Figure 13:
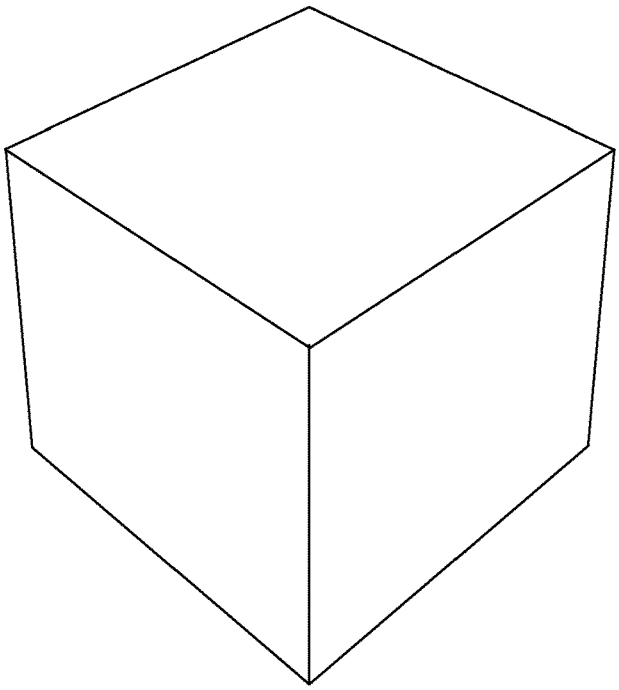
FIG. 13 illustrates the flat pattern of FIG. 12, after the two sides have been bent to create the illusion of a cube.

A basic cube illusion may be formed out of paper, cardboard, or other material using the flat pattern shape shown in FIG. 12A and FIG. 12B, and by bending the two downwardly disposed flanges along the respective dashed lines to produce what is visually perceived to be the cube shown n FIG. 13.

For the illusion signage fixture 100, the selectively shaped light boxes 121*a,* 121*b,* and 121*c* may be selectively arranged in order to use distortions that create art image that will predictably be misinterpreted as a cube, and with the aid of particular lighting and graphics, may furthermore be perceived as a cube from an inverse hollow arrangement, with graphics that appear as a body in motion, tracking the movement of the observer.

The distortions are monocular cues that help the observer identify the shape, and include linear perspective and relative size. The perspective is provided by linear edges that are aligned with and converge on vanishing points. The relative size is provided by the visual expectation that the objects at a greater distance appear smaller than objects that are closer. On a cube, if the sides have applied images, the observer expects the closer part of the image to appear larger. These visual cues are preferably manipulated in combination with particular lighting that eliminates shadows from the hollow of the inverse cube to provide the most effective illusion, because an actual cube would not have the top surface in shadow, whereas a hollow cube is naturally in shadow. Proper implementation of the perspective, the relative size, and the lighting provide the inverse hollow cube disclosed herein to appear as a body in motion, tracking the movement of the observer. As noted hereinabove, in one embodiment this body-in-motion appearance may be accentuated through the use of a graphic made of lenticular sign material. (i.e., frosted plastic image shifting material that makes the image appear to move as you change the viewing angle).

When a real cube is partially rotated or observed at an angle, the sides of the cube appear to be trapezoids. The closer edges appear longer in accordance with the relative size expectation of the user. To recreate this appearance of the side of a cube using three tiles (or the three light boxes), and to furthermore form the visual appearance of a cube from an inverted hollow arrangement, a distorted trapezoidal shape may be used. Exemplary peripheral shapes that may be used for the diffuser, mixing chamber, and light box housing are shown in FIGS. 14A-14C, with the shape shown in FIG. 14A for use for the light box 121*a,* with the shape shown in FIG. 14B for use for the light box 121*b,* and with the shape shown in FIG. 14C for use for the light box 121*c.* For the distorted trapezoidal shape used, the more distant edges are longer (i.e., D2>D1), and in one embodiment D2 may be in the range of 1% to 7% larger than D1. In another embodiment D2 may be in the range of 7% to 14% larger than D1, and in yet another embodiment D2 may be in the range of 14% to 20% larger than D1. Also, the adjacent edges of the three tiles may be separated using the gaps shown in FIG. 14. As seen in FIG. 14, gap C and gap D may be the same, respectively, as gap E and gap F; however differences in those respective gaps may be used to van the illusion. The gap A and zap B may also be the same as gap C and gap D, respectively. Gaps B, C, and E are each preferably larger than gaps A, D, and F, and so the gap may vary linearly along the extent of the adjacent light boxes. In one embodiment gaps, A, D, and F may each be in the range of 0.01 inch to 0.10 inch. In another embodiment gaps A, D, and F may each be in the range of 0.1 inch to 0.25 inches. In yet another embodiment, gaps A, D, and F may each be greater than 0.25 inches. The extent of the gap utilized may depend upon the size of the graphic used, which may graphic size depend upon the location where the 3D sign is to be used and the distance the viewers may typically be positioned away from the sign, and it may also depend upon the size of the bezel that may frame the graphic, which may tend to detract from the illusion. Also, in one embodiment, gaps B, C, and E may be in the range of 1% to 10% larger than gaps A, D, and F. In another embodiment gaps B, C, and E may be in the range of 10% to 15% larger than gaps A, D, and F. In yet another embodiment gaps B, C, and E may greater than 15% larger than gaps A, D, and F.

A suitably distorted graphic may be produced by transforming a square graphic to a trapezoidal graphic, such that each corner point of the square is transformed to a location that aligns with the corners that define the tile. The position of all intermediate points may thus be scaled relative to the transformation of the four corner points. The points may be scaled linearly. Another way to describe this distortion process is that any point on the distorted graphic (defined by the tile shape) can be defined as a perimeter point of a smaller distorted graphic of the same relative shape. As such it can be located on the undistorted perimeter of a smaller square.

Figure 15A:
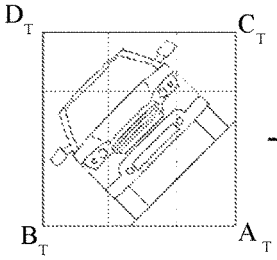
FIG. 15A illustrates a graphic that may be suitably deformed for use upon the top diffuser represented in FIG. 14.
Figure 15B:
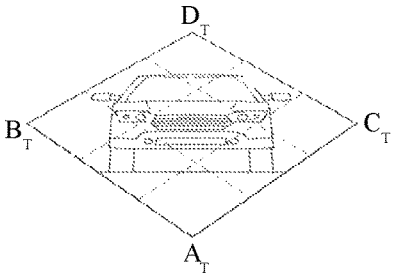
FIG. 15B illustrates the graphic of FIG. 15A after being deformed for use upon the top diffuser represented in FIG. 14.
Figure 15C:
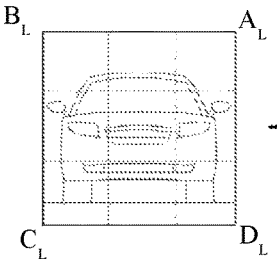
FIG. 15C illustrates a graphic that may be suitably deformed for use upon the left diffuser represented in FIG. 14.
Figure 15D:
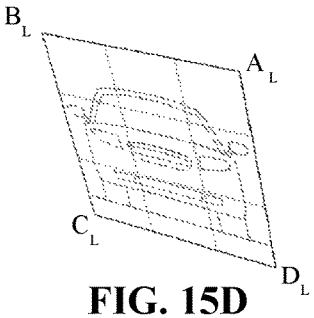
FIG. 15D illustrates the graphic of FIG. 15C after being deformed for use upon the left diffuser represented in FIG. 14.
Figure 15E:
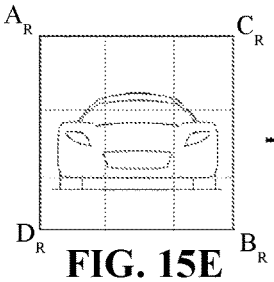
FIG. 15E illustrates a graphic that may be suitably deformed for use upon the right diffuser represented in FIG. 14.
Figure 15F:
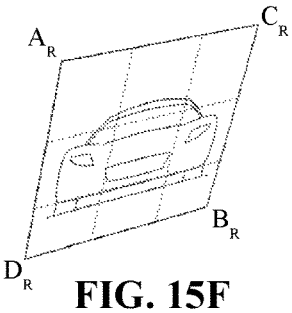
FIG. 15F illustrates the graphic of FIG. 15E after being deformed for use upon the right diff user represented in FIG. 14.
Figure 15G:
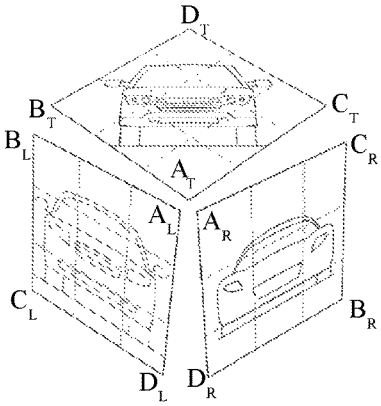
FIG. 15G illustrates the graphics of FIGS. 15B, 15D, and 15F, prior to being selectively positioned with respect to each other, as when secured to the diffusers represented in FIG. 14.
Figure 15H:
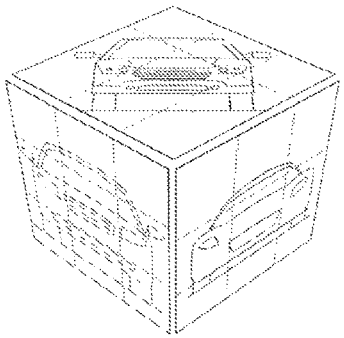
FIG. 15H illustrates the graphics of FIGS, 15B, 15D, and 15F, after being selectively positioned with respect to each other, as when secured to the diffusers represented in FIG. 14.
Figure 15I:
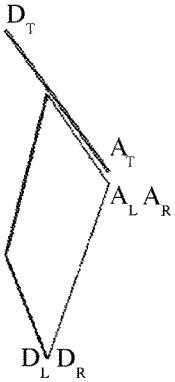
FIG. 15I is a side view of the selectively positioned graphics shown in FIG. 15H.

Examples of such a distorted trapezoidal-shaped graphic produced from a square-shaped graphic using this process is shown by square graphic in FIGS. 15A, 15C, and 15E being deformed to respectively produce the trapezoidal graphic of FIGS. 15B, 15D, and 15F.

Lastly, the face of the tiles (i.e., the exterior planar surface of the light diffusers) are preferably oriented an angle to the adjacent tile (light diffuser). In theory, the angle may be in the range of 91° to 179°, where 90° would be used for an actual cube and 180° would be a completely flattened arrangement. However, to produce an illusion as desired and depicted herein, the angle between the planar surfaces may be in the range of 100 degrees to 140 degrees, and may more preferably be in the range of 110 degrees to 130 degrees, and may most preferably be in the range of 115 degrees to 125 degrees. In one embodiment, the angle used may depend to some extent upon the amount of distortion used for the trapezoidal shape (i.e., the extent to which D2 is greater than D1). In one embodiment where D2 is greater than D1, by about 5% to 6%, an angle of 119 degrees may be used to provide the described illusion.

The illuminated graphic is best observed against a dark background, and since it is best not to allow the observer to see behind the triad, the shaped housing 159 of the illusion light assembly 120 is utilized, and is preferably a dark color, most preferably being black. In one embodiment, the black background may be formed by covering it with black carpet, which produces a very non-reflective finish.

Figure 6:
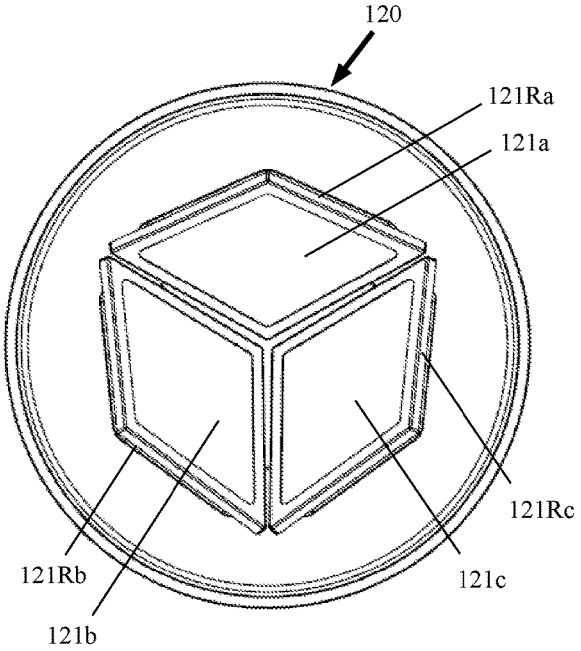
FIG. 6 is a front view of the light boxes and the housing arrangement shown in FIG. 4.
Figure 7:
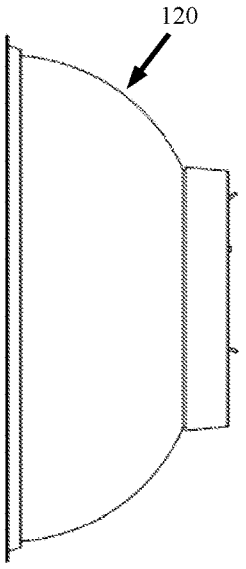
FIG. 7 is a side view of the light boxes and the housing arrangement shown in FIG. 4.

As seen in FIG. 4 and FIG. 6, one or more brackets (e.g., bracket 121Ra and/or bracket 121Rb and/or bracket 121Rc) may be used to properly orient and mount the light boxes 121*a*/121*b*/121*c* within the interior of the shaped housing 150, whereby the diffuser 128*a* of the first light box 121*a,* the diffuser 123*b* of the second light box, and the diffuser 128*c* of the third light box are selectively positioned with respect to each other for the first, second, and third selectively shaped diffuser peripheries to create the desired inverse cube illusion. Additionally or alternatively, the light boxes 121*a*/121*b*/121*c* may be mounted within the interior of the shaped housing 150 using adhesive, or using snaps positioned on the housing of the light box that may be coupled to corresponding snap members on the shaped housing 150 of the illusion light assembly 120.

Figure 16:
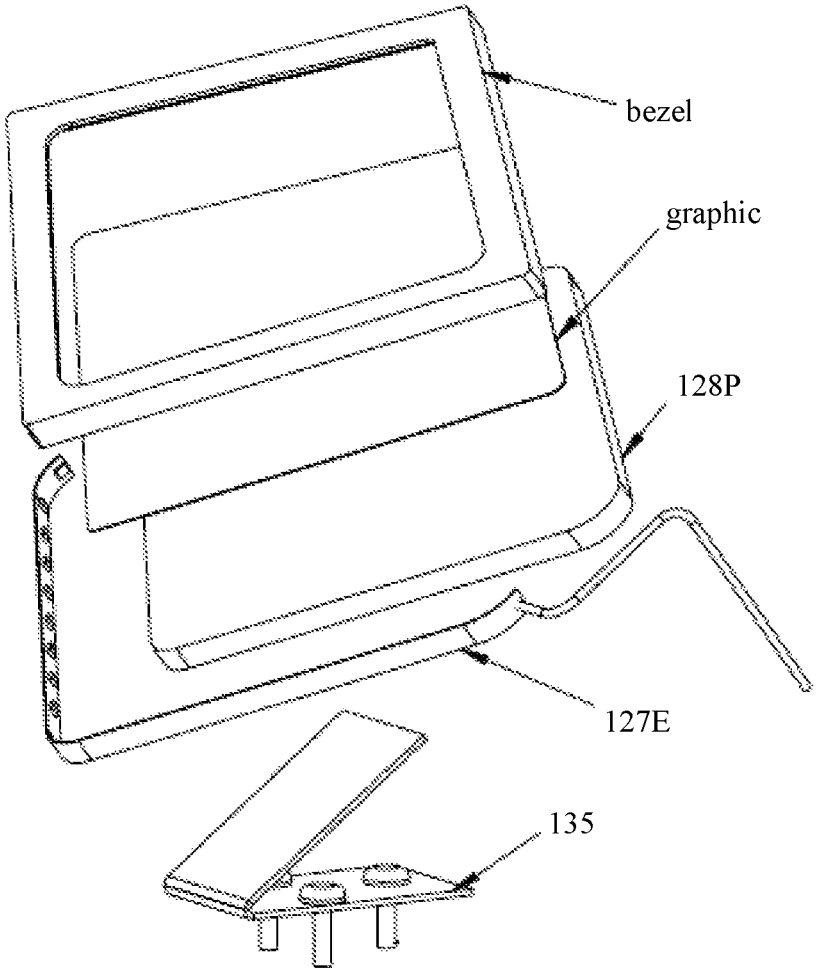
FIG. 16 illustrates an alternate embodiment for the light box that may be used in the illusion signage fixture of FIG. 1.

FIG. 16 illustrates an alternate embodiment for the light box construction, in which the diffuser may be replaced by a light transmitting panel 128P that may be surrounded by a strip of LED edge lights 127E, where the panel may be attached directly to the housing 150 using an angle bracket 135. Note that in another embodiment, the strip of lights 127*a* of the light box 121*a* may be replaced by a plurality lights that may be equally distributed along the back surface of the mixing chamber 126*a.* Also, in another embodiment the strip of edge lights may be used with the diffuser.

FIG. 17 illustrates an exploded view of the component parts for an alternate embodiment in the form of illusion signage fixture 101 that may use a shaped housing 151 that may have a box shape to provide a dark background and dark environment for the illusion light assembly. The poster structure 111 used to support the light assembly may have a circular opening therein to permit viewing of the front of the illusion light assembly 120.

As seen in FIG. 18 the illusion signage fixture of FIG. 17 may be created as a left-hand version 101L and a mirror image right-hand version 101R (mirrored except for possibly the graphics used), and which mirrored versions are shown in FIG. 18 prior to being joined to create the two-sided signage arrangement of FIG. 20.

FIG. 21 illustrates an alternate embodiment in the form of illusion signage fixture 102 that may use a shaped housing 152 with an interior chamber having a cylindrical shape for housing the light boxes in a dark environment. The illusion signage fixture 102 may be utilized with or without any poster structure, and may be mounted directly to any suitable surface.

Figure 22:
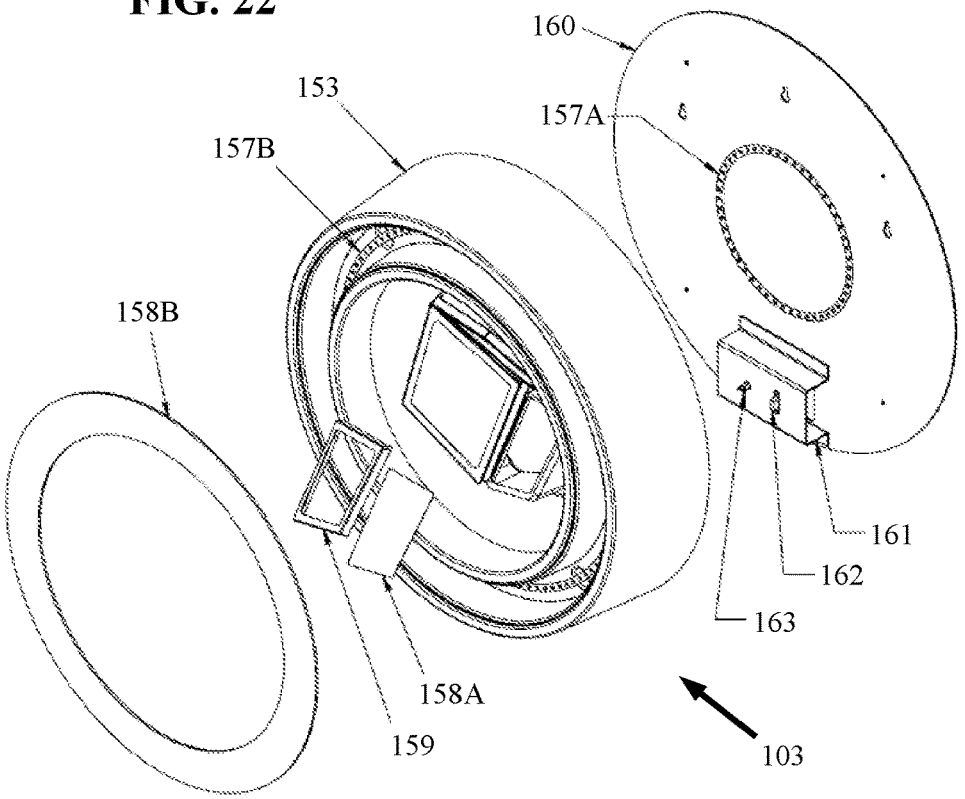
FIG. 22 illustrates an exploded view of yet another embodiment of a housing that may be used to house light boxes for another embodiment of the illusion signage fixture.

FIG. 22 illustrates an exploded view of the component parts for yet another alternate embodiment is the form of illusion signage fixture 103 that may use a shaped housing 153 with a cylindrical interior chamber for housing the light boxes. In this embodiment, the light boxes 121*a*/121*b*/121*c* may be used, or alternatively, a transparent panel or diffuser may instead be used to support the bezel 159 to releasably mount the graphic 158A thereto, which may be illuminated by a ring of LEDs 157A that may be mounted to a back plate 160 of the housing 153, eliminating the light box housings. The back plate 160 may also support a switch box 161 that may include an on/off 162, and a DC plug 163. Also, the shaped housing 153 may also have a concentric outer chamber for housing a ring of additional lights 157B that may illuminate a disk-shaped outer ring graphic 158B. The illusion signage fixture 103 may be utilized with or without any poster structure, and may be mounted directly to any suitable surface.

Figure 23:
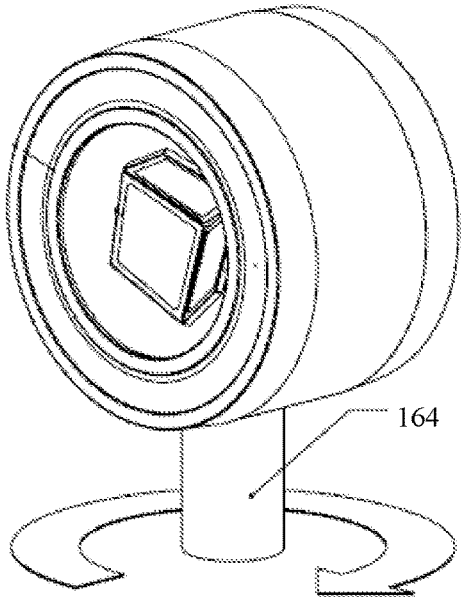
FIG. 23 illustrates a perspective view of yet another embodiment of a housing and light boxes, being constructed similar to the arrangement shown in FIG. 22, but being two-sided, and mounted for at least the housing to be able to pivot.

As seen in FIG. 23, the illusion signage fixture 103 may be pivotally mounted to be pivoted by a rotary actuator 164 that may be utilized to cause the housing 153 to pivot about an axis a set amount of degrees in both directions (clockwise and counterclockwise), to cause the graphic(s) attached thereto to pivot. In another embodiment based on this arrangement, the light boxes in the chamber (or the panel therein) may similarly be pivotally mounted and may be driven by the same actuator or by another rotary actuator to pivot, with the pivoting of the light boxes and corresponding graphics in the chamber being at the same rate, and to the same extent as the pivoting of the housing and the outer graphic, but may instead be opposite in phase, such that the graphic therein and the outer ring graphic may pivot in opposites directions (i.e., when the outer graphic ring is rotating in a clockwise direction, the graphics on the light boxes in the inner chamber may be rotating in a counterclockwise direction, until both simultaneously reverse rotation directions). FIG. 22 also illustrates that two copies of the illusion signage fixture 102 shown in FIG. 21, as well as two copies of the illusion signage fixture 103 shown in FIG. 22, may be mounted back-to-back to provide for two-sided signage.

Figure 24:
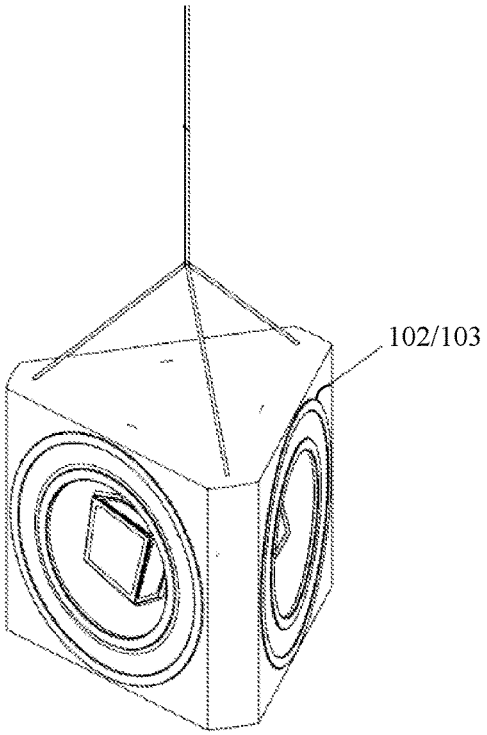
FIG. 24 illustrates plurality usage of the housing and light boxes of FIG. 22, being used in each side of a three-sided structure.

FIG. 24 illustrates plurality usage of the illusion signage fixture 102/103 being used in each side of a three-sided structure, which may be hung using a wire of rope.

FIG. 25 illustrates an illusion signage fixture 104 that is constructed similar to the illusion signage fixture 100 shown in FIGS. 1-3, except that it may utilize poster signage structure 111 in which the sides of the box form a lip with a large front opening that is configure to receive a correspondingly shaped graphic 111G, which may be supported against a diffuser 111D by a bezel 111B. The graphic 111G may be illuminated by lights mounted to the rear panel 111P of the structure, which lights may be LED backlight strips 111L.

FIG. 26 illustrates an illusion signage fixture 105 where the light boxes are LCD screens, and the graphic may be supplied by images transmitted onto the LCD screens, which images can be distorted in the LCD screens as desired, and discussed hereinabove. Therefore, the graphic may be visualized in any manner described hereinabove. In fact, various different approaches for visualization of the graphic may be used for the three light boxes, thus an LCD screen may be used for only one or two of the three light boxes of the 3D signage.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A three-dimensional sign comprising:

a first light box comprising: an enclosure; and a light transmitting panel positioned over an opening in said enclosure; said light transmitting panel comprising a first selectively-shaped periphery;

a second light box comprising: an enclosure; and a light transmitting panel positioned over an opening in said enclosure of said second light box; said light transmitting panel of said second light box comprising a second selectively-shaped periphery;

a third light box comprising: and enclosure; and a light transmitting panel positioned over an opening in said enclosure of said third light box; said light transmitting panel of said third light box comprising a third selectively-shaped periphery;

a plurality of lights;

wherein said light transmitting panel of said first light box, said light transmitting panel of said second light box, and said light transmitting panel of said third light box are selectively positioned with respect to each other for said first, second, and third selectively shaped peripheries to create an inverse cube illusion; and a respective graphic for each said light transmitting panel of said first, second, and third light boxes, each said graphic configured to be respectively visualized by a portion of said plurality of lights.

2. The three-dimensional sign according to claim 1, wherein said light transmitting panel of said first light box, said light transmitting panel of said second light box, and said light transmitting panel of said third light box being selectively positioned with respect to each other comprises positions wherein:

a gap between said first light box and said second light box is configured to taper linearly;

a gap between said first light box and said third light box is configured to taper linearly; and a cap between said second light box and said third light box is configured to taper linearly.

3. The three-dimensional sign according to claim 2, wherein each of said first, second, and third selectively shaped peripheries comprise a trapezoidal shape.

4. The three-dimensional sign according to claim 3, wherein said second selectively shaped periphery is a mirrored copy of said third selectively shaped periphery.

5. The three-dimensional sign according to claim 4, wherein each said respective graphic comprises an image distorted to respectively correspond to said trapezoidal shape of said first, second, and third selectively shaped peripheries.

6. The three-dimensional sign according to claim 1, wherein each said light transmitting panel comprises a light diffuser.

7. The three-dimensional sign according to claim 1, wherein each of said first, second, and third light boxes comprises a bezel configured to releasably secure said respective graphic to said respective light transmitting panel, to be backlit by said portion of said plurality of lights.

8. The three-dimensional sign according to claim 1, further comprising a selectively shaped housing configured to receive and support said selectively positioned first, second, and third light boxes therein.

9. The three-dimensional sign according to claim 8, wherein each of said light boxes comprises a light mixing chamber.

10. The three-dimensional sign according to claim 9, wherein an interior surface of said selectively shaped housing comprises a dark color; and wherein an exterior of each of said light boxes comprises a dark color.

11. The three-dimensional sign according to claim 10, wherein said interior surface of said selectively shaped housing is covered with black carpet.

12. The three-dimensional sign according to claim 10, wherein a rear portion of said selectively shaped housing comprises an enclosure for electronics.

13. The three-dimensional sign according to claim 8, further comprising a shaped bezel configured to mount a second graphic to said selectively shaped housing; and a second plurality of lights positioned to back-light said second graphic.

14. The three-dimensional sign according to claim 8, wherein said selectively shaped housing comprises a shape from the group of shapes consisting of: a dome shape; a cylindrical shape; a pyramid shape; a pyramid frustum shape; a cube shape; a dodecahedron shape; an octahedron shape; an icosahedron shape; and a polyhedron shape.

15. A method of creating a three-dimensional inverse cube illusion sign comprising:

forming a diffuser of a first light box with a first selectively-shaped periphery;

forming a diffuser of a second light box with a second selectively-shaped periphery;

forming a diffuser of a third light box with a third selectively-shaped periphery;

positioning the diffuser of the first light box, the diffuser of the second light box, and the diffuser of the third light box for creating an inverse cube illusion using the respective selectively-shaped peripheries;

positioning a plurality of lights for illuminating each diffuser of each of the first light box, the second light box, and the third light box; and positioning a respective graphical image for contacting the diffuser of the first light box, the diffuser of the second light box, and the diffuser of the third light box; and backlighting of each respective graphical image.

* * * * *